US011338421B2

(12) United States Patent
Po

(10) Patent No.: US 11,338,421 B2
(45) Date of Patent: May 24, 2022

(54) PNEUMATIC NAIL GUN

(71) Applicant: Basso Industry Corp., Taichung (TW)

(72) Inventor: Chien-Kuo Po, Taichung (TW)

(73) Assignee: Basso Industry Corp., Taichung (TW)

( * ) Notice: Subject to any disclaimer, the term of this patent is extended or adjusted under 35 U.S.C. 154(b) by 212 days.

(21) Appl. No.: 16/174,490

(22) Filed: Oct. 30, 2018

(65) Prior Publication Data

US 2019/0126452 A1 May 2, 2019

(30) Foreign Application Priority Data

Nov. 2, 2017 (TW) ..... 106137863

(51) Int. Cl.
*B25C 1/04* (2006.01)
*B25C 1/08* (2006.01)
*B25C 1/00* (2006.01)

(52) U.S. Cl.
CPC ..... *B25C 1/047* (2013.01); *B25C 1/008* (2013.01); *B25C 1/042* (2013.01)

(58) Field of Classification Search
CPC ..... B25C 1/04; B25C 1/041; B25C 1/042; B25C 1/047; B25C 1/08
USPC ..... 173/135, 136; 227/10, 130
See application file for complete search history.

(56) References Cited

U.S. PATENT DOCUMENTS 5,752,643 A * 5/1998 MacVicar ..... B25C 1/008 227/10
6,123,241 A * 9/2000 Walter ..... B25C 1/08 123/46 SC
6,220,496 B1 * 4/2001 Hirai ..... B25C 1/047 227/130
6,572,000 B2 * 6/2003 Hirai ..... B25C 1/04 227/130
8,011,547 B2 9/2011 Leimbach et al.
8,523,035 B2 * 9/2013 Pedicini ..... B25C 1/047 227/2
8,671,899 B2 * 3/2014 Al-Khulaifi ..... F01L 7/021 123/80 D (Continued)

FOREIGN PATENT DOCUMENTS

CN 106457539 A 2/2017
CN 107249823 A 10/2017

OTHER PUBLICATIONS

Search Report appended to an Office Action, which was issued to Taiwanese counterpart application No. 106137863 by the TIPO dated Jun. 24, 2021, with an English translation thereof.

*Primary Examiner* — Thanh K Truong
*Assistant Examiner* — Patrick B Fry
(74) *Attorney, Agent, or Firm* — Burris Law, PLLC

(57) ABSTRACT

A pneumatic nail gun includes a gun body, a muzzle connected to the gun body for receiving a nail, a cylinder unit disposed in the gun body, an air valve unit having a cover portion, and a striking unit having a piston. The cylinder unit includes a gas storage chamber, a striking cylinder having a cylinder chamber 510 in fluid communication with the gas storage chamber, and at least one gas storage cylinder in fluid communication with the gas storage chamber for receiving a gas having a pre-determined gas pressure. The cover portion is operable to interrupt fluid communication between the cylinder chamber and the gas storage chamber, and to allow the fluid communication such that the piston is pushed by the gas to strike the nail.

14 Claims, 11 Drawing Sheets

(56) References Cited

U.S. PATENT DOCUMENTS

| | | | | |
|---|---|---|---|---|
| 8,875,969 | B2 * | 11/2014 | Pedicini | B25C 1/04 227/130 |
| 9,050,712 | B2 * | 6/2015 | Campbell | B25C 1/047 |
| 9,770,818 | B2 * | 9/2017 | Largo | B25C 1/041 |
| 2004/0134961 | A1 * | 7/2004 | Wolf | B25C 1/08 227/10 |
| 2006/0180631 | A1 * | 8/2006 | Pedicini | B25C 1/06 227/130 |
| 2013/0336809 | A1 * | 12/2013 | Antoun | B25C 1/04 417/53 |
| 2018/0036870 | A1 * | 2/2018 | Komazaki | B25C 1/047 |
| 2018/0290279 | A1 * | 10/2018 | Kobori | B25C 1/06 |

* cited by examiner

PNEUMATIC NAIL GUN

CROSS-REFERENCE TO RELATED APPLICATION

This application claims priority of Taiwanese Invention Patent Application No. 106137863, filed on Nov. 2, 2017.

FIELD

The disclosure relates to a nail gun, and more particularly to a pneumatic nail gun.

BACKGROUND

Referring to FIG. 1, U.S. Pat. No. 8,011,547 B2 discloses a fastener driving tool 1 that includes a main body 11, a muzzle 12, a lifter 13, a working cylinder 14, a piston 15 and a striking pin 16. The muzzle 12 is connected to a lower end of the main body 11, and is used for loading a nail 2 therein. The lifter 13 is connected to the muzzle 12, and can be electromechanically actuated to rotate counterclockwise. The working cylinder 14 is disposed in the main body 11, and defines an internal chamber 17. The striking pin 16 is co-movably connected to a bottom end of the piston 15. The piston 15 and the striking pin 16 are disposed in the internal chamber 17, such that the piston 15 and the working cylinder 14 cooperatively define a gas pressure chamber 141 and a cylinder chamber 142. The volumes of the gas pressure chamber 141 and the cylinder chamber 142 are changeable with movement of the piston 15 in the internal chamber. The striking pin 16 has a striking portion 161 that is used for striking the nail 2, and a plurality of teeth 162 that mesh with the lifter 13.

When the lifter 13 rotates counterclockwise, since the lifter 13 meshes with the teeth 162 of the striking pin 16, the piston 15 and the striking pin 16 are driven to move upwardly, and the piston 15 compresses the air contained in the gas pressure chamber 141. When the lifter 13 further rotates such that the teeth 162 of the striking pin 16 are disengaged from the lifter 13, and the piston 15 is pushed by the compressed air in the gas pressure chamber 141 to move downwardly, so that the striking pin 16 is co-moved therewith to strike the nail 2 with the striking portion 161. Multiple nails can be continuously ejected by the fastener driving tool 1 with repetition of the abovementioned actions.

Although the fastener driving tool 1 is capable of pneumatically ejecting nails, there are some features may need to be improved.

Firstly, the piston 15 is normally moved to a position where the air in the gas pressure chamber 141 is compressed, allowing a striking action to be promptly conducted by disengaging the teeth 162 of the striking pin 16 from the lifter 13. However, if either one of the striking pin 16 and the lifter 13 is malfunctioned, the striking action may be conducted by the compressed air, which may cause serious danger to a user or people nearby.

Secondly, during each striking operation, the compressed air is completely decompressed, which may result in excess driving force applied to the nail 2 when the nail 2 is driven into a soft material or is short. Moreover, the complete decompression may result in a greater recoil force or vibration of the fastener driving tool 1, adversely reducing the service life of the components of the fastener driving tool 1.

SUMMARY

Therefore, an object of the disclosure is to provide a pneumatic nail gun that can alleviate at least one of the drawbacks of the prior art.

According to a first aspect of the present disclosure, a pneumatic nail gun is adapted for firing a nail along a firing path.

The pneumatic nail gun includes a gun body, a muzzle, a cylinder unit, an air valve unit and a striking unit. The muzzle is connected to the gun body and is adapted for receiving the nail. The cylinder unit is disposed in the gun body, and includes a main body, a striking cylinder connected to the main body, at least one gas storage cylinder connected to the main body, and a cap connected to the main body and cooperating with the main body to define a gas storage chamber therebetween. The striking cylinder has a cylinder chamber that is in fluid communication with the gas storage chamber. The at least one gas storage cylinder is in fluid communication with the gas storage chamber and is adapted for receiving a gas having a pre-determined gas pressure. The air valve unit includes an air valve that is disposed in the gas storage chamber and that has a cover portion movable between a sealing position to interrupt fluid communication between the cylinder chamber and the gas storage chamber, and an opening position to allow fluid communication between the cylinder chamber and the gas storage chamber. The striking unit includes a piston that is movable in the cylinder chamber of the striking cylinder between a stand-by position adjacent to the main body, and a striking position farther away from the main body than the stand-by position. The striking unit further includes a striking pin that is co-movably connected to the piston. The piston is actuated electromechanically to move from the striking position to the stand-by position, and is actuated pneumatically to move from the stand-by position to the striking position. When the piston is at the stand-by position and when the cover portion of the air valve is at the sealing position, the gas is confined in the gas storage chamber and the at least one gas storage cylinder. When the cover portion of the air valve is moved to the opening position, the gas is released from the gas storage chamber into the cylinder chamber to push the piston to the striking position so that the striking pin is co-moved with the piston to strike the nail.

According to a second aspect of the present disclosure, another pneumatic nail gun is adapted for firing a nail along a firing path.

The pneumatic nail gun includes a gun body, a muzzle, a cylinder unit, an air valve unit and a striking unit. The muzzle is connected to the gun body and is adapted for receiving the nail. The cylinder unit is disposed in the gun body, and includes a main body, a striking cylinder connected to the main body, at least one gas storage cylinder connected to the main body, and a cap connected to the main body and cooperating with the main body to define a gas storage chamber therebetween. The striking cylinder has a cylinder chamber that is in fluid communication with the gas storage chamber. The at least one gas storage cylinder is in fluid communication with the gas storage chamber and is adapted for receiving a gas having a pre-determined gas pressure. The at least one gas storage cylinder and the striking cylinder are located at a side of the main body, and the cap is located at an opposite side of the main body such that the gas storage chamber is located between the cap and the cylinder chamber of the striking cylinder. The air valve unit includes an air valve that is disposed in the gas storage chamber and that has a cover portion movable between a sealing position to interrupt fluid communication between the cylinder chamber and the gas storage chamber, and an opening position to allow fluid communication between the cylinder chamber and the gas storage chamber. The striking unit includes a piston that is movable in the cylinder chamber of the striking cylinder between a stand-by position adjacent to the main body, and a striking position farther away from the main body than the stand-by position. The striking unit further includes a striking pin that is co-movably connected to the piston. The piston is actuated electromechanically to move from the striking position to the stand-by position, and is actuated pneumatically to move from the stand-by position to the striking position. When the piston is at the stand-by position and when the cover portion of the air valve is at the sealing position, the gas is confined in the gas storage chamber and the at least one gas storage cylinder. When the cover portion of the air valve is moved to the opening position, the gas is released from the gas storage chamber into the cylinder chamber to push the piston to the striking position so that the striking pin is co-moved with the piston to strike the nail.

BRIEF DESCRIPTION OF THE DRAWINGS

Other features and advantages of the disclosure will become apparent in the following detailed description of the embodiment and variation with reference to the accompanying drawings, of which.

DETAILED DESCRIPTION

Figure 1:
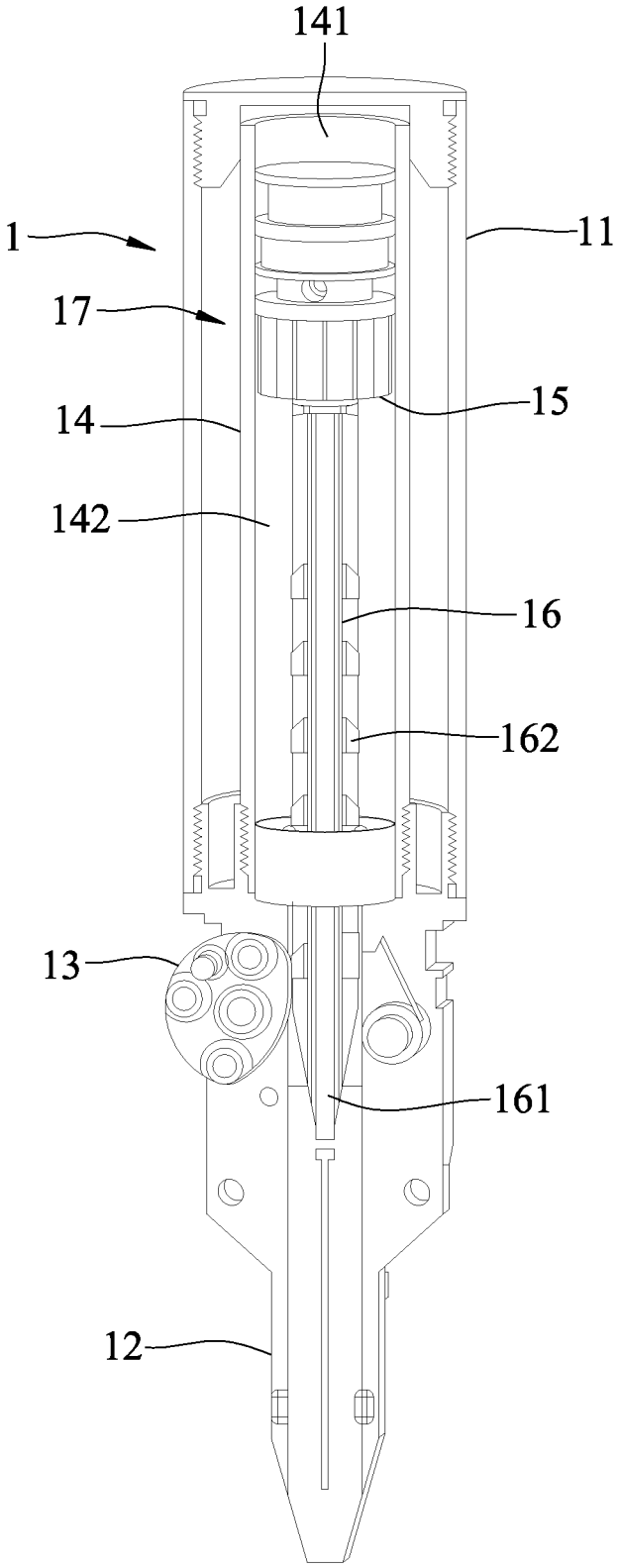
FIG.1 PRIOR ART
FIG. 1 is a schematic view of a fastener driving tool according to U.S. Pat. No. 8,011,547 B2.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
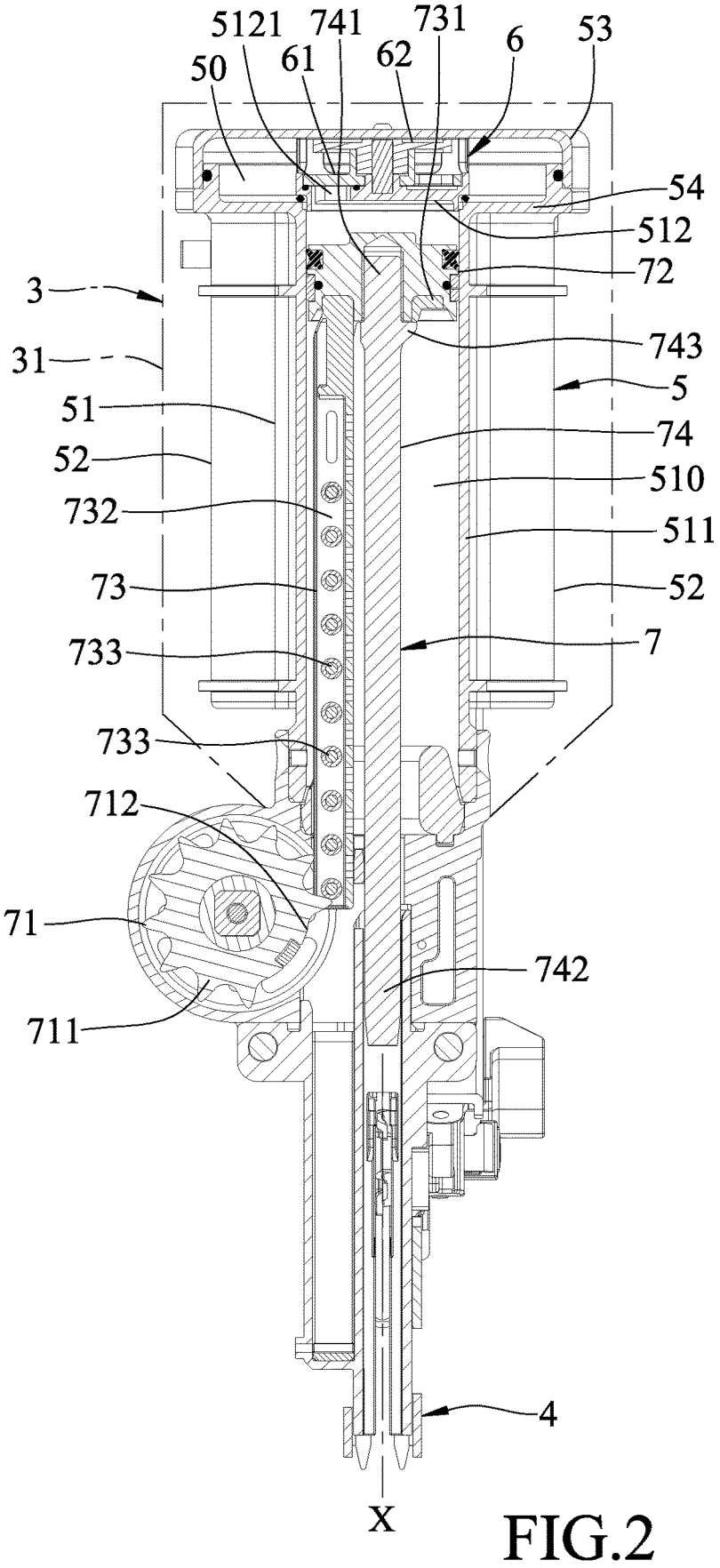
FIG. 2 is a schematic sectional view of an embodiment of a pneumatic nail gun according to the present disclosure.

Referring to FIG. 2, an embodiment of a pneumatic nail gun is adapted for firing a nail (not shown) along a firing path (X). The pneumatic nail gun includes a gun body 3, a muzzle 4, a cylinder unit 5, an air valve unit 6 and a striking unit 7.

The muzzle 4 is connected to the gun body, and is adapted for receiving the nail.

Figure 3:
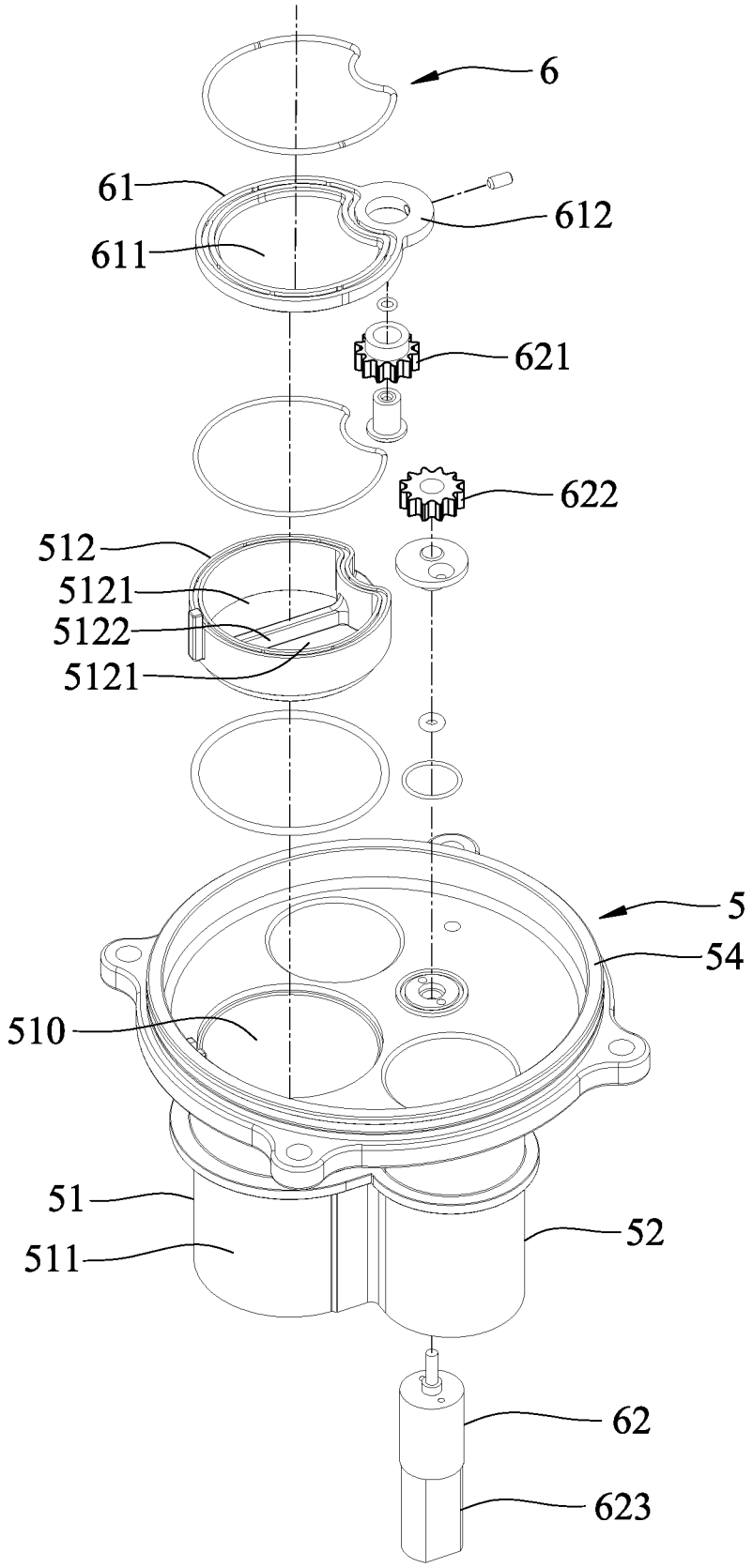
FIG. 3 is a fragmentary and exploded perspective view of the embodiment, showing a cylinder unit and an air valve unit of the embodiment.
Figure 4:
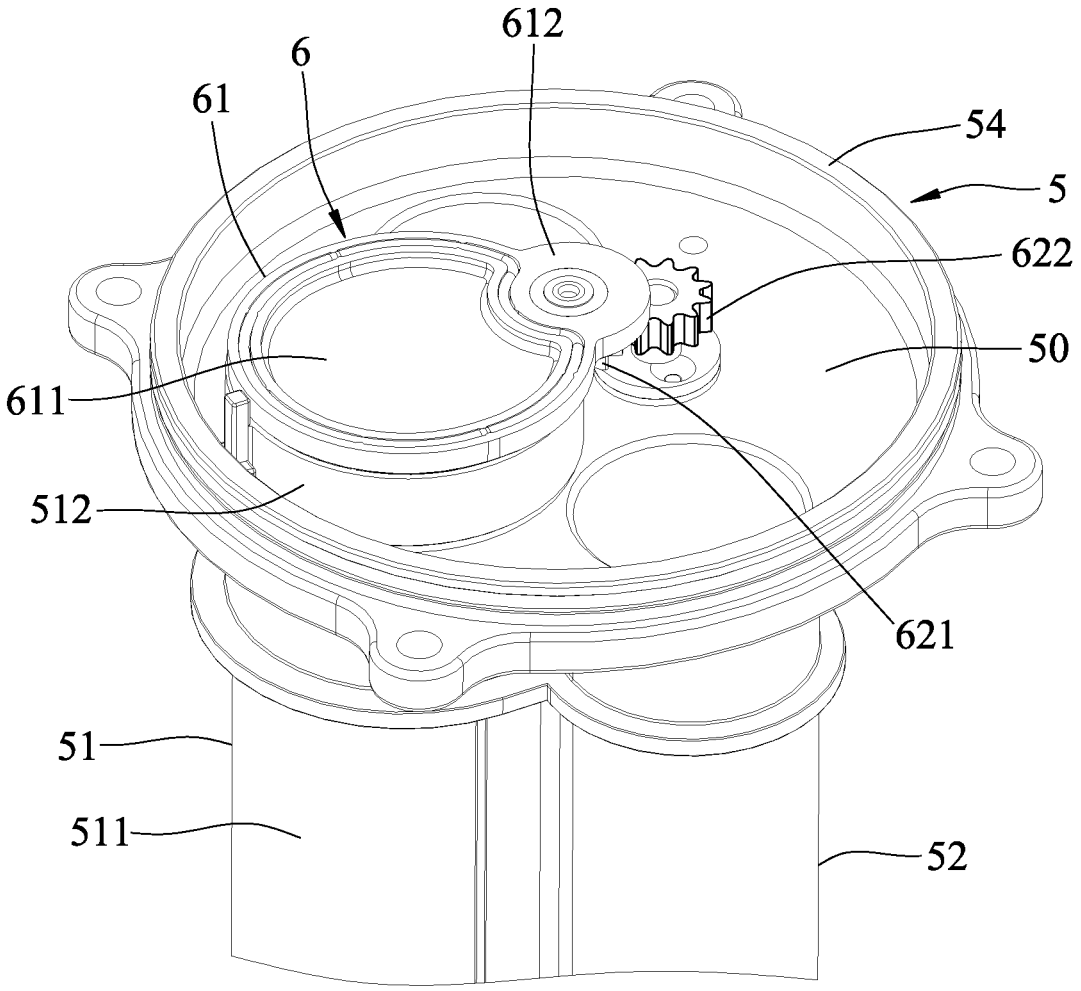
FIG. 4 is a fragmentary perspective view of the embodiment, showing the cylinder unit and the air valve unit being assembled.
Figure 5:
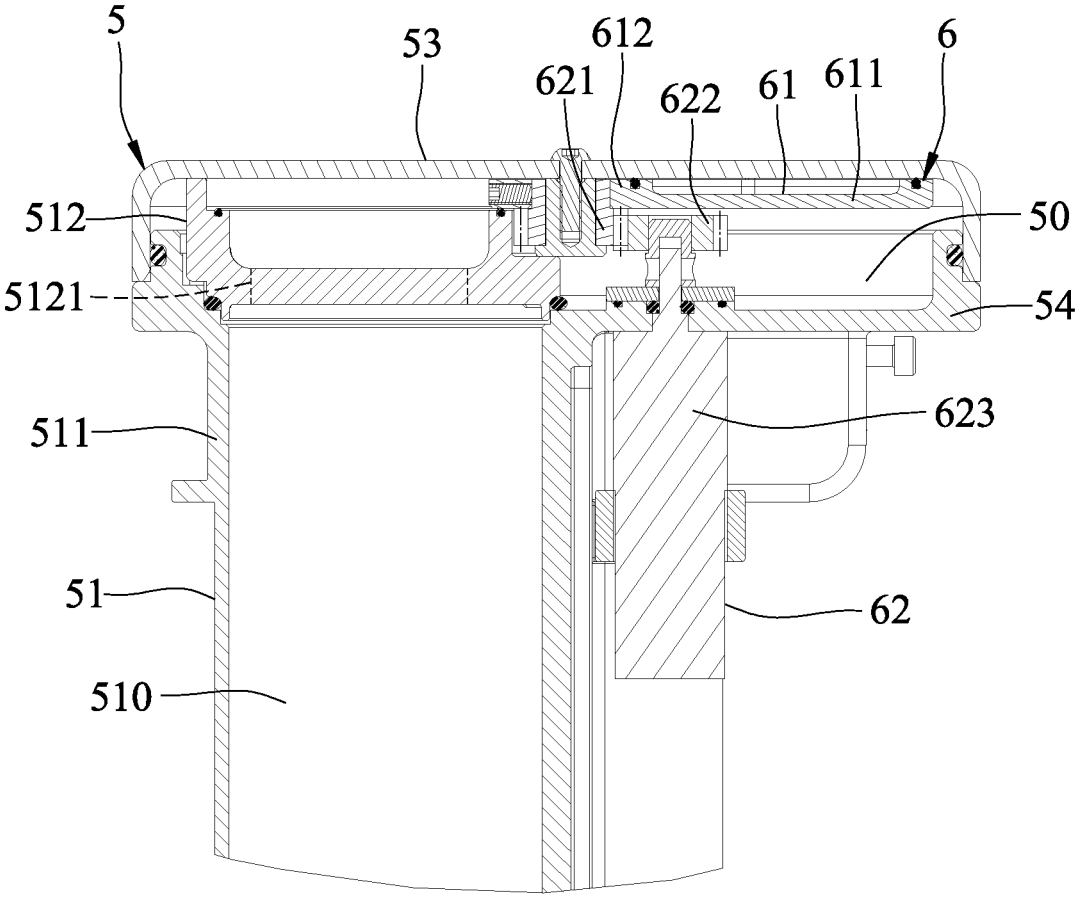
FIG. 5 is a fragmentary sectional view, showing a cover portion of the air valve unit being at an opening position to allow fluid communication between a cylinder chamber and a gas storage chamber of the cylinder unit.

Referring further to FIGS. 3 to 5, the cylinder unit 5 is disposed in the gun body 3, and includes a main body 54, a striking cylinder 51 connected to the main body 54, two gas storage cylinders 52 (see FIG. 6) connected to the main body 54, and a cap 53. The cap 53 is connected to the main body 54, and cooperates with the main body 54 to define a gas storage chamber 50 therebetween. The striking cylinder 51 has a cylinder body 511 that defines a cylinder chamber 510 in fluid communication with the gas storage chamber 50, and a compartment member 512 that is connected to the cylinder body 511. The compartment member 512 has two spaced-apart gas passages 5121 that intercommunicate the cylinder chamber 510 and the gas storage chamber 50, and a rib 5122 that is disposed between the gas passages 5121. In this embodiment, sum of the sectional areas of the gas passages 5121 equals substantially to the sectional area of the cylinder chamber 510. The gas storage cylinders 52 are in fluid communication with the gas storage chamber 50, and are adapted for receiving a gas having a pre-determined gas pressure. In this embodiment, the gas storage cylinders 52 and the striking cylinder 51 are located at a side of the main body 54, and the cap 53 is located at an opposite side of the main body 54 such that the gas storage chamber 50 is located between the cap 53 and the cylinder chamber 510 of the striking cylinder 51 (i.e., as shown in FIG. 5, the cylinder chamber 510 being located under the gas storage chamber 50).

The air valve unit 6 includes an air valve 61 that is disposed in the gas storage chamber 50, and a driving assembly 62 that is mounted to the cylinder unit 5. The air valve 61 has a cover portion 611, and a connecting portion 612 that is connected to a peripheral part of the cover portion 611. In this embodiment, each of the main body 54 and the cover portion 611 of the air valve 61 is circular in shape. The connecting portion 612 of the air valve 61 is rotatably connected to a central portion of the cap 53 of the cylinder unit 5 (i.e., rotatably disposed at a central portion of the main body 54). The area of the cover portion 611 of the air valve 61 equals substantially to the sum of the sectional areas of the gas passages 5121. The cover portion 611 of the air valve 61 is movable between a sealing position to seal the gas passages 5121 and to interrupt fluid communication between the cylinder chamber 510 and the gas storage chamber 50, and an opening position to open the gas passages 5121 and to allow fluid communication between the cylinder chamber 510 and the gas storage chamber 50. The driving assembly 62 includes a driven gear 621 that is co-rotatably connected to the air valve 61 and that is located in the gas storage chamber 50, a driving gear 622 that is rotatably connected to the main body 54 of the cylinder unit 5 and that meshes with the driven gear 621, and a motor 623 that is operable to move the cover portion 611 of the air valve 61.

Specifically, the motor 623 is operable to drive rotation of the driving gear 622 and thus the driven gear 621 to move the cover portion 611 of the air valve 61. In this embodiment, the motor 623 is located between the gas storage cylinders 52 and adjacent to the striking cylinder 51.

Figure 7:
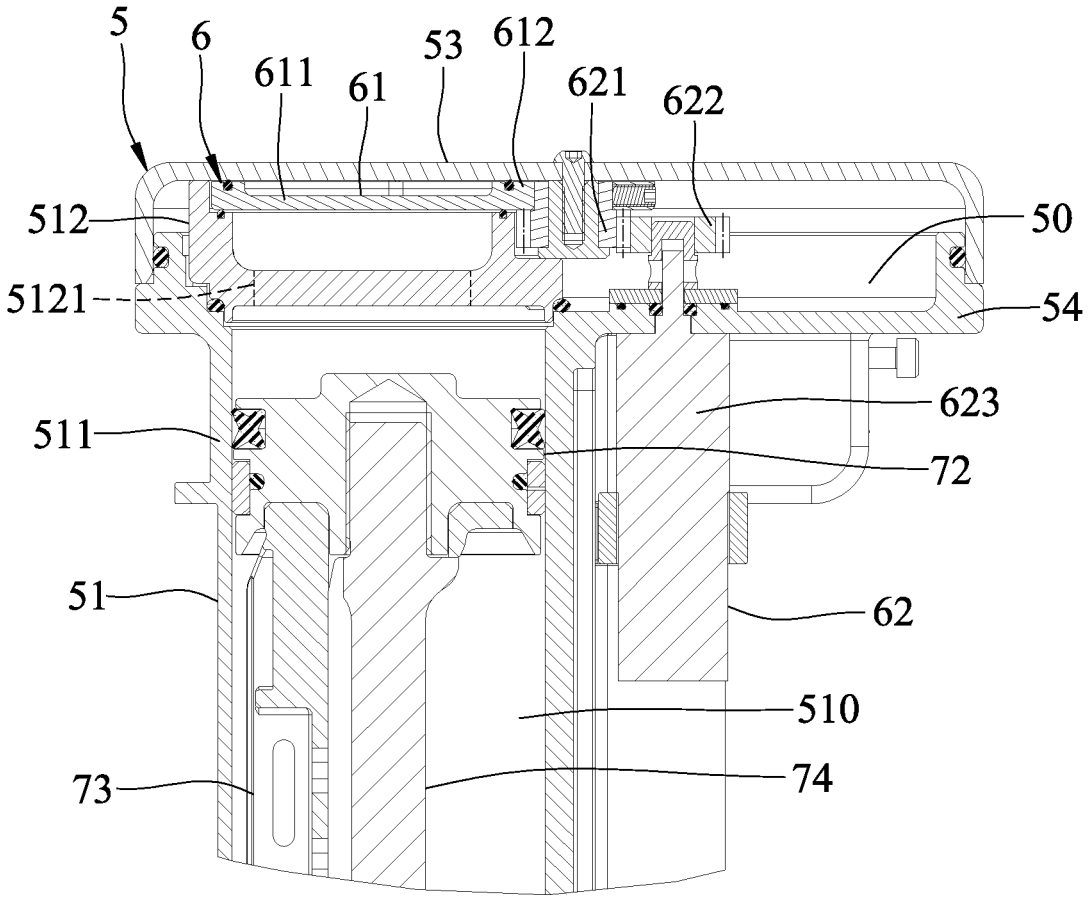
FIG. 7 is a fragmentary sectional view, showing the cover portion of the air valve unit being at a sealing position to interrupt fluid communication between the cylinder chamber and the gas storage chamber of the cylinder unit.

Referring to FIGS. 2 and 7, the striking unit 7 includes a lifting gear 71 that is rotatably connected to the muzzle 4, a piston 72 that is movable in the cylinder chamber 510 of the striking cylinder 51, a gear rack 73 that is co-movably connected to the piston 72, and a striking pin 74 that is co-movably connected to the piston 72. In this embodiment, the gear rack 73 is detachable from the piston 72, and is adapted to extend in a direction parallel to the firing path (X).

The lifting gear 71 is operable to rotate unidirectionally, and has a toothed portion 711 and a non-toothed portion 712. The piston 72 is in airtight contact with an inner wall of the cylinder body 511, and is prevented from contacting the cover portion 611 of the air valve 61 by the rib 5122 of the compartment member 512. The piston 72 is actuated pneumatically to move from a stand-by position (see FIG. 2) adjacent to the main body 54 to a striking position (see FIG. 11) farther away from the main body 54 than the stand-by position. The piston 72 is further actuated electromechanically to move from the striking position to the stand-by position. When the piston 72 is at the stand-by position and when the cover portion 611 of the air valve 61 is at the sealing position to seal the gas passages 5121, the gas is confined in the gas storage chamber 50 and the gas storage cylinders 52. When the cover portion 611 of the air valve 61 is moved to the opening position to open at least a part of the gas passages 5121, the gas is released from the gas storage chamber 50 and the gas storage cylinders 52 into the cylinder chamber 510 of the striking cylinder 51 to pneumatically push the piston 72 to the striking position so that the striking pin 74 is co-mowed to strike the nail.

The gear rack 73 detachably meshes with the lifting gear 71 so as to be driven by the lifting gear 71 to move the piston 72 from the striking position to the stand-by position. The gear rack 73 includes a ring portion 731 that is connected to the piston 72, a rack plate 732 that extends from the ring portion 731 in the direction parallel to the firing path (X), and a plurality of spaced-apart teeth 733 that are aligned on the rack plate 732 along the direction parallel to the firing path (X). In this embodiment, each of the teeth 733 is cylindrical.

The striking pin 74 has a connecting end portion 741 that is connected to the piston 72, a striking end portion 742 that is opposite to the connecting end portion 741 and that is adapted to strike the nail when the piston 72 is moved to the striking position, and an abutting portion 743 that is connected between the connecting end portion 741 and the striking end portion 742 and that abuts against the ring portion 731 of the gear rack 73 to secure the gear rack 73 to the piston 72.

Figure 10:
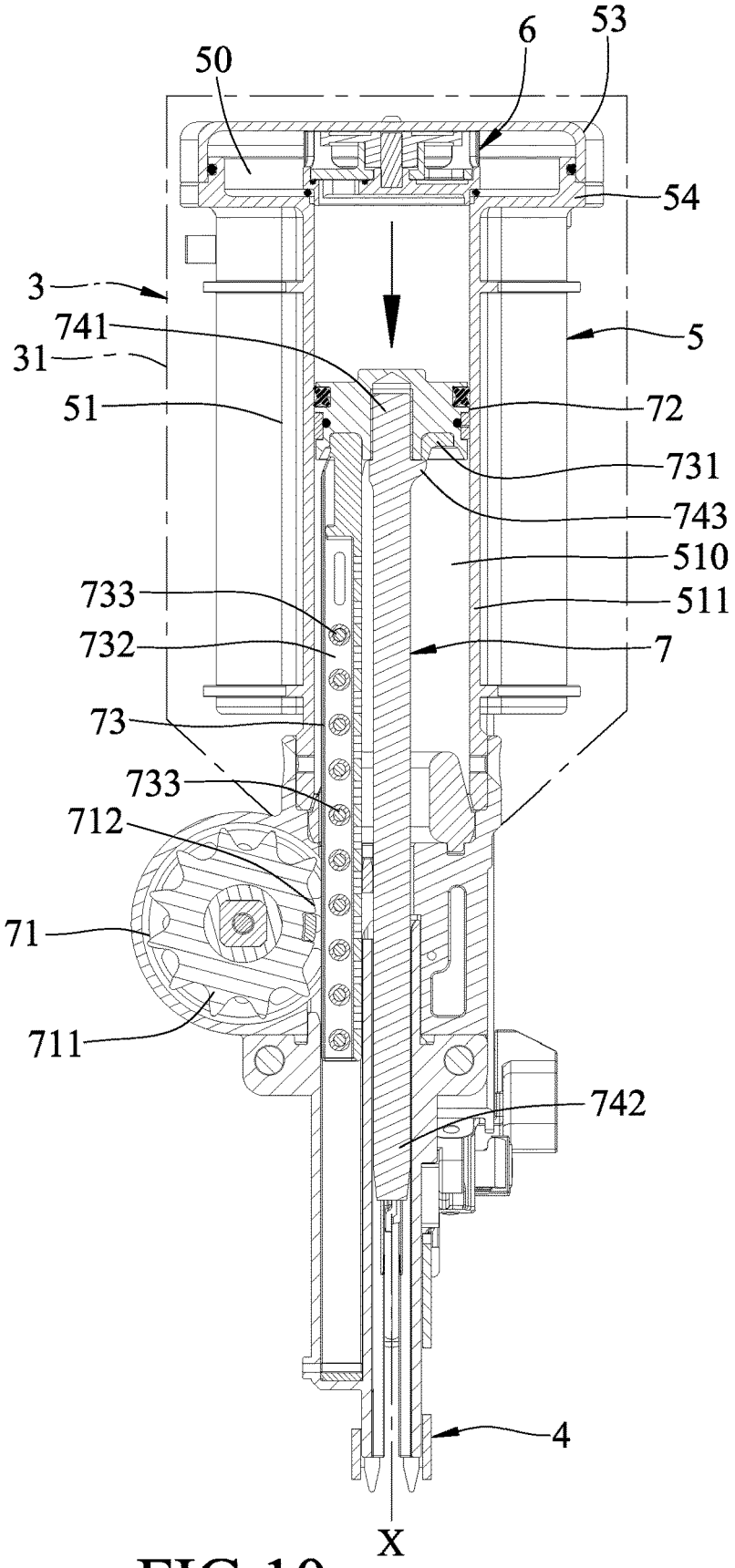
FIG. 10 is a schematic sectional view of the embodiment, showing a piston of a striking unit being moved from stand-by position toward a striking position.

Referring to FIG. 10, when the lifting gear 71 is actuated electromechanically to rotate unidirectionally in a counterclockwise direction and when the non-toothed portion 712 of the lifting gear 71 is rotated to correspond in position to the gear rack 73, the teeth 733 of the gear rack 73 do not mesh with the toothed portion 711 of the lifting gear 71 and the piston 72 is pushed pneumatically by the gas to the striking position.

Figure 11:
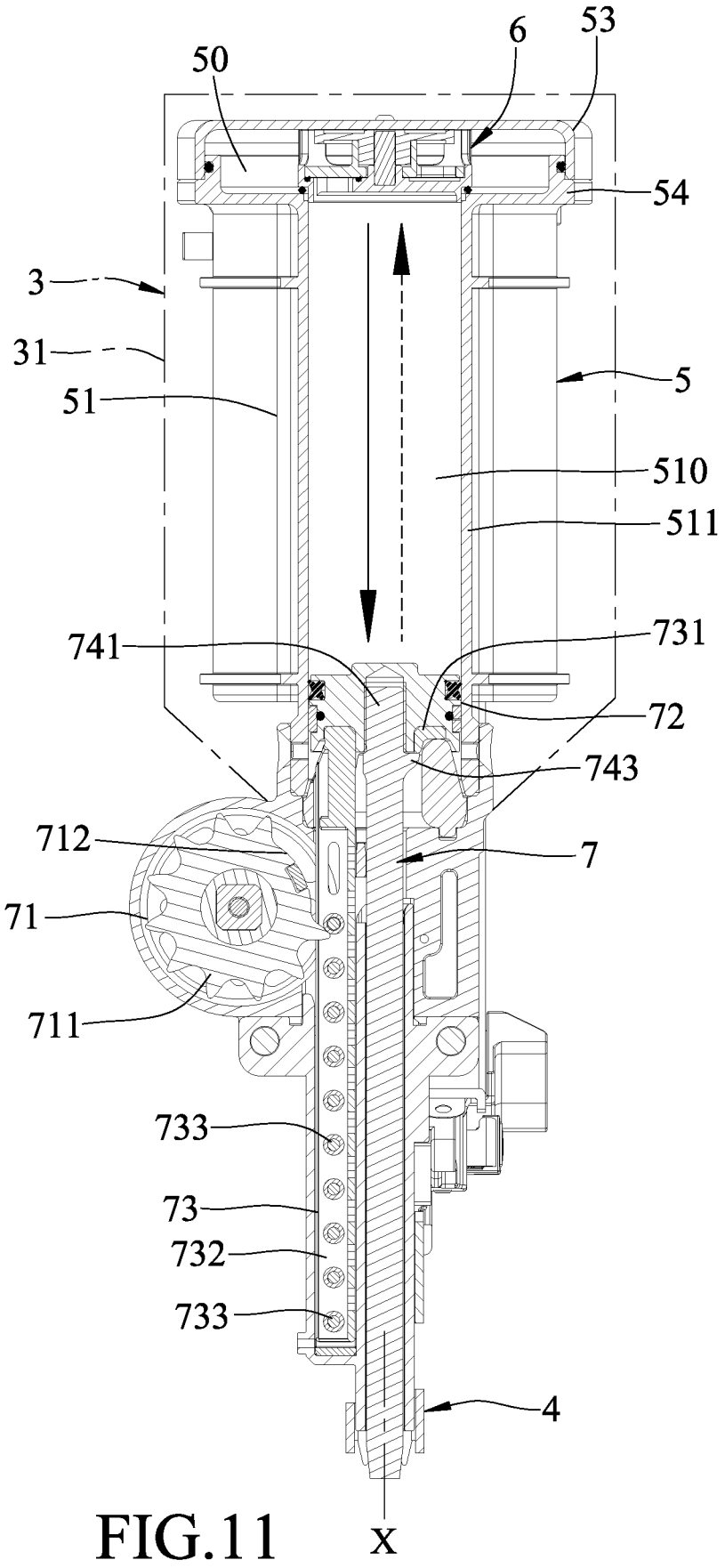
FIG. 11 is a schematic sectional view of the embodiment, showing that the piston of the striking unit is moved to the striking position.

Referring to FIG. 11, when at least a part of the teeth 733 of the gear rack 73 meshes with the toothed portion 711 of the lifting gear 71, unidirectional rotation (i.e., counterclockwise rotation) of the lifting gear 71 results in unidirectional movement of the gear rack 73 (i.e., in this embodiment, upward movement) so as to move the piston 72 from the striking position to the stand-by position.

Figure 6:
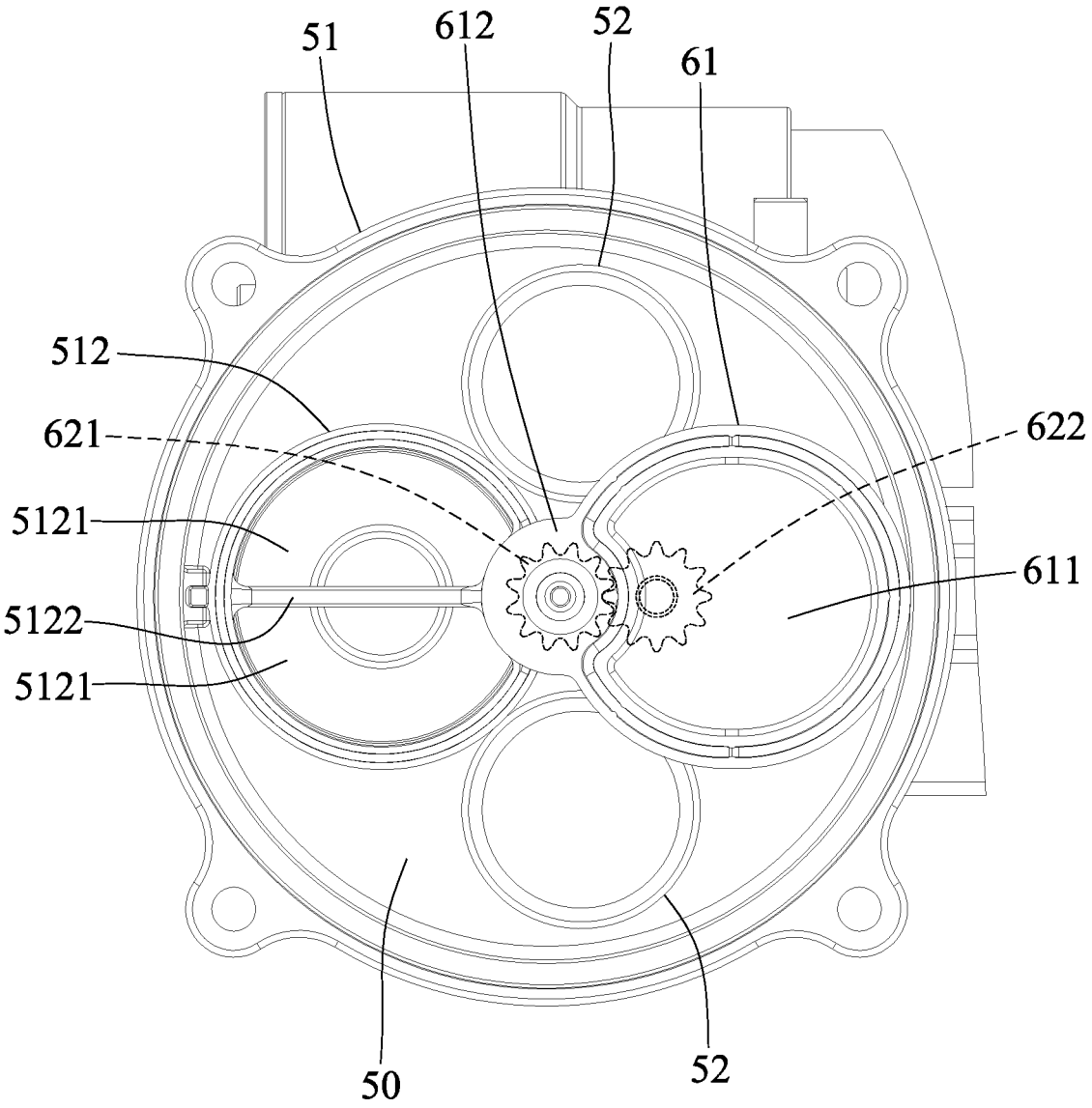
FIG. 6 is a fragmentary top view, showing the cover portion of the air valve unit being at the opening position.

Referring to FIGS. 5, 6 and 11, when the piston 72 is moved from the striking position to the stand-by position, the piston 72 pushes the gas to pass through the gas passages 5121 into the gas storage chamber 50 and the gas storage cylinders 52 and the gas is compressed.

Figure 8:
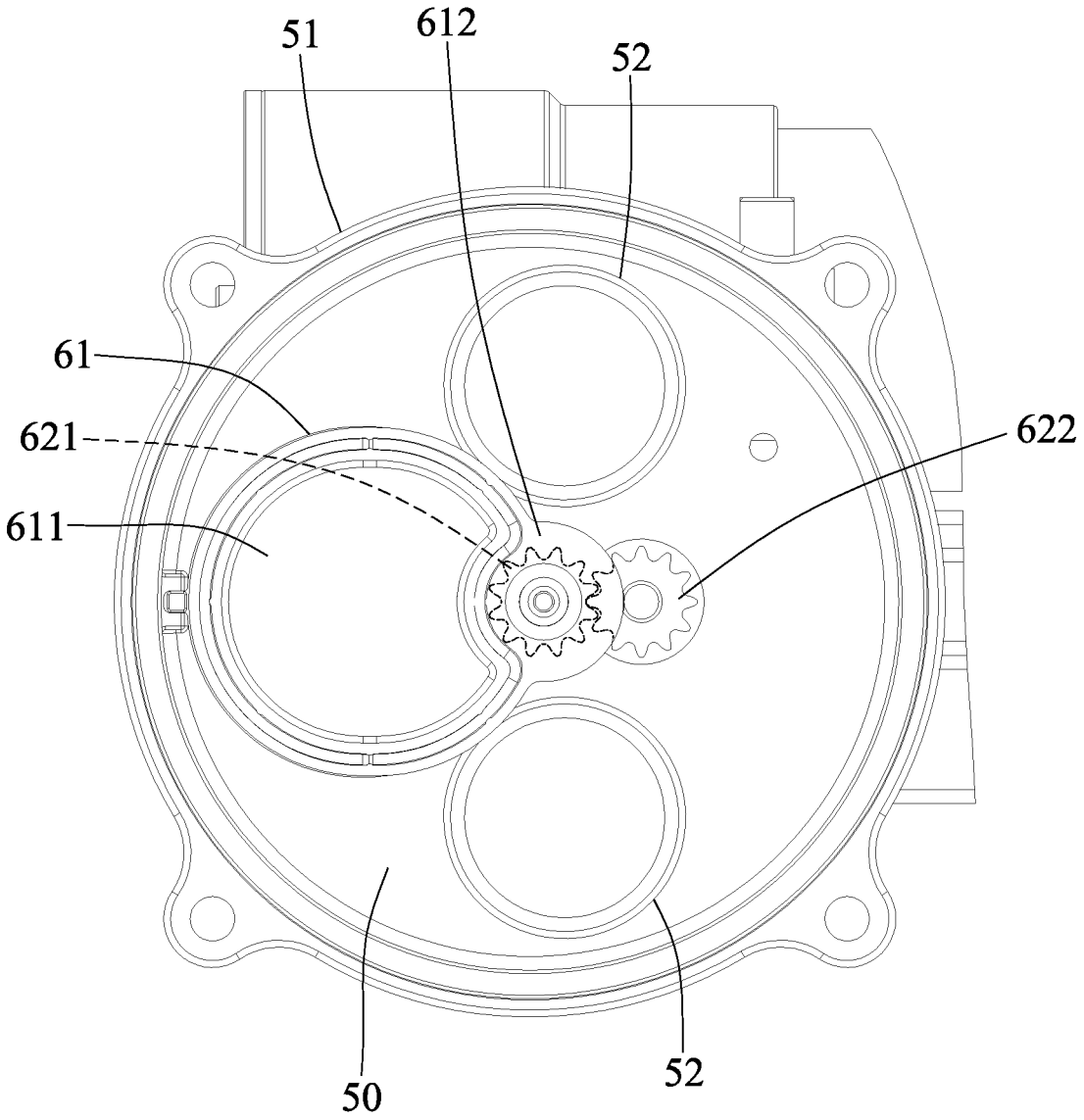
FIG. 8 is a fragmentary top view, showing the cover portion of the air valve unit being at the sealing position.

Referring to FIGS. 7 and 8, when the piston 72 is moved to the stand-by position, the cover portion 611 of the air valve 61 is actuated by the driving assembly 62 to move to the sealing position to interrupt fluid communication between the cylinder chamber 510 and the gas storage chamber 50. Since the compressed gas is confined in the gas storage chamber 50 and the gas storage cyliniders 52, the piston 72 in the cylinder chamber 510 is not pushed by the gas.

Referring to FIGS. 5, 6, 10 and 11, to fire the nail, the cover portion 611 of the air valve 61 is moved to the opening position through actuation of the driving assembly 62 to allow the gas to pass through the gas passages 5121 of the compartment member 512. Meanwhile, the lifting gear 71 is operated to rotate unidirectionally such that the non-toothed portion 712 of the lifting gear 71 corresponds in position to the gear rack 73 and the teeth 733 of the gear rack 73 do not mesh with the toothed portion 711 of the lifting gear 71, allowing the piston 72 to be pushed by the gas to move from the stand-by position to the striking position so as to strike the nail with the striking end portion 742 of the striking pin 74.

After the abovementioned operation, the lifting gear 71 continues to rotate unidirectionally such that a part of the toothed portion 711 of the lifting gear 71 meshes with the teeth 733 of the gear rack 73 to move the piston 72 from the striking position to the stand-by position to thereby compress the gas in the gas storage chamber 50 and the gas storage cylinders 52. Repetition of the abovementioned operation allows the performance of continuous firing multiple nails.

Figure 9:
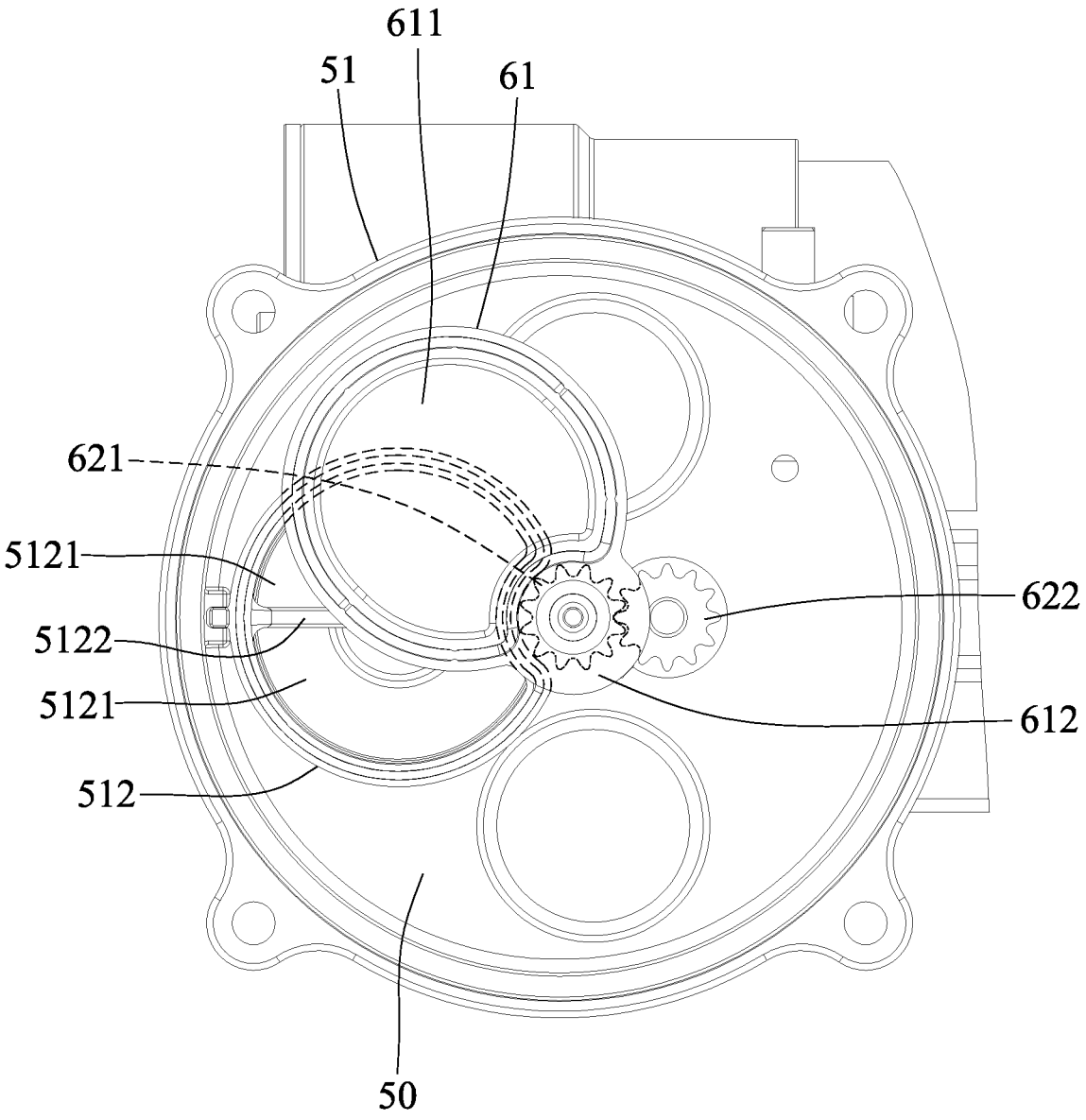
FIG. 9 is a view similar to FIG. 6, but illustrating that the air valve unit partially covers a gas passage of the cylinder unit.

Referring to FIG. 9, it is worth mentioning that the opening position of the cover portion 611 of the air valve 61 may mean that the cover portion 611 still covers a portion of the gas passages 5121 of the compartment member 512 to reduce the rate of gas passing through the gas passages 5121, thereby resulting in a decrease in the momentum of the piston 72. Such low momentum strike may be applied to soft materials (e.g., softwood) or shorter nails. The degree of coverage of the gas passages 512:1 may be adjusted according to practical requirements.

Some of the merits of this disclosure are summarized below.

The cylinder chamber 510 of the striking cylinder 51 and the gas storage chamber 50 are separated by the cover portion 611 of the air valve 61. In a case where either one of the lifting gear 71 and the gear rack 73 is damaged, the gas confined in the cylinder chamber 510 between the piston 72 and the cover portion 611 of the air valve 61 cannot push the piston 72 to strike the nail, thereby improving operational safety of a user.

By controlling the degree of coverage of the gas passages 5121 of the compartment member 512, the momentum of the piston 72 can be controlled for application of materials of different hardnesses. The user comfort is also improved with reduced recoil force or vibration of the pneumatic nail gun.

The gear rack 73 and the striking pin 74 are separated elements and can be independently replaced when needed, reducing cost of maintenance. The striking pin 74 may also be changed based on the nails or the materials of the workpieces, so as to prolong the service life of the striking pin 74.

In the description above, for the purposes of explanation, numerous specific details have been set forth in order to provide a thorough understanding of the embodiment and variation. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects and that one or more features or specific details from one embodiment may be practiced together with one or more features or specific details from another embodiment, where appropriate, in the practice of the disclosure.

While the disclosure has been described in connection with what are considered the exemplary embodiment and variation, it is understood that this disclosure is not limited to the disclosed embodiment and variation but is intended to cover various arrangements included within the spirit and scope of the broadest interpretation so as to encompass all such modifications and equivalent arrangements.

What is claimed is:

1. A pneumatic nail gun adapted for firing a nail along a firing path, said pneumatic nail gun comprising:

a gun body;

a muzzle connected to said gun body and adapted for receiving the nail;

a cylinder unit disposed in said gun body and including a main body, a striking cylinder connected to said main body, at least one gas storage cylinder defining a gas receiving space and connected to said main body, and a cap connected to said main body and cooperating with said main body to define a gas storage chamber therebetween, said striking cylinder having a cylinder chamber that is in fluid communication with said gas storage chamber, said at least one gas storage cylinder being in fluid communication with said gas storage chamber and being adapted for receiving a gas having a pre-determined gas pressure;

an air valve unit including an air valve that is disposed in said gas storage chamber and that has a cover portion movable between a sealing position to interrupt fluid communication between said cylinder chamber and said gas storage chamber, and an opening position to allow fluid communication between said cylinder chamber and said gas storage chamber; and a striking unit including only one piston that is movable in said cylinder chamber of said striking cylinder between a stand-by position adjacent to said main body, and a striking position farther away from said main body than the stand-by position, said striking unit further including a striking pin that is co-movably connected to said piston, said only one piston being actuated electromechanically to move from the striking position to the stand-by position, the gas in said gas storage chamber and said gas receiving space of the gas storage cylinder being compressed into a compressed gas only by the only one piston when the only one piston is moved from the striking position to the stand-by position, said only one piston being actuated pneumatically to move from the stand-by position to the striking position by the compressed gas when the compressed gas is released, wherein when said piston is at the stand-by position and when said cover portion of said air valve is at the sealing position, the gas is confined in said gas storage chamber and said at least one gas storage cylinder and is compressed, and wherein when said cover portion of said air valve is moved to the opening position, the gas is released from the gas storage chamber into said cylinder chamber to push said piston to the striking position so that said striking pin is co-moved with said piston to strike the nail.

2. The pneumatic nail gun as claimed in claim 1, wherein:

said striking cylinder of said cylinder unit includes a cylinder body that defines said cylinder chamber, and a compartment member that is connected to said cylinder body and that has at least one gas passage intercommunicating said cylinder chamber and said gas storage chamber;

when said cover portion of said air valve is at the sealing position, said cover portion of said air valve seals said at least one gas passage; and when said cover portion of said air valve is at the opening position, said at least one gas passage is opened.

3. The pneumatic nail gun as claimed in claim 1, wherein:

said cover portion of said air valve is circular in shape; and said air valve further has a connecting portion that is connected to a peripheral part of said cover portion and that is rotatably connected to said cylinder unit.

4. The pneumatic nail gun as claimed in claim 1, wherein said air valve unit further includes a driving assembly that is mounted to said cylinder unit and that includes a motor operable to move said cover portion of said air valve.

5. The pneumatic nail gun as claimed in claim 4, wherein:

said driving assembly further includes a driven gear that is co-rotatably connected to said air valve, and a driving gear that is rotatably connected to said cylinder unit and that meshes with said driven gear; and said motor is operable to drive rotation of said driving gear and thus said driven gear to move said cover portion of said air valve.

6. The pneumatic nail gun as claimed in claim 1, wherein said striking unit further includes a lifting gear that is rotatably connected to said muzzle, and a gear rack that is co-movably connected to said piston and that detachably meshes with said lifting gear so as to be driven by said lifting gear to move said piston from the striking position to the stand-by position.

7. The pneumatic nail gun as claimed in claim 6, wherein said gear rack is detachable from said piston, and is adapted to extend in a direction parallel to the firing path.

8. The pneumatic nail gun as claimed in claim 6, wherein:

said lifting gear is operable to rotate unidirectionally, and has a toothed portion and a non-toothed portion;

said gear rack has a plurality of spaced-apart teeth;

when said non-toothed portion of said lifting gear is rotated to correspond in position to said gear rack, said teeth of said gear rack do not mesh with said toothed portion of said lifting gear, and said piston is pushed by the gas to the striking position; and when at least a part of said teeth of said gear rack meshes with said toothed portion of said lifting gear, unidirectional rotation of said lifting gear results in unidirectional movement of said gear rack so as to move said piston from the striking position to the stand-by position.

9. The pneumatic nail gun as claimed in claim 1, wherein said at least one gas storage cylinder and said striking cylinder are located at a side of said main body, and said cap is located at an opposite side of said main body such that said gas storage chamber is located between said cap and said cylinder chamber of said striking cylinder.

10. The pneumatic nail gun as claimed in claim 9, wherein:

said striking cylinder of said cylinder unit includes a cylinder body that defines said cylinder chamber, and a compartment member that is connected to said cylinder body and that has at least one gas passage interconnecting said cylinder chamber and said gas storage chamber;

when said cover portion of said air valve is at the sealing position, said cover portion of said air valve seals said at least one gas passage; and when said cover portion of said air valve is at the opening position, said at least one gas passage is opened.

11. The pneumatic nail gun as claimed in claim 9, wherein:

said cover portion of said air valve is circular in shape; and said air valve further has a connecting portion that is connected to a peripheral part of said cover portion and that is rotatably connected to said cylinder unit.

12. The pneumatic nail gun as claimed in claim 9, wherein said air valve unit further includes a driving assembly that is mounted to said cylinder unit and that includes a motor operable to move said cover portion of said air valve.

13. The pneumatic nail gun as claimed in claim 12, wherein:

said driving assembly further includes a driven gear that is co-rotatably connected to said air valve, and a driving gear that is rotatably connected to said cylinder unit and that meshes with said driven gear; and said motor is operable to drive rotation of said driving gear and thus said driven gear to move said cover portion of said air valve.

14. The pneumatic nail gun as claimed in claim 9, wherein said striking unit further includes a lifting gear that is rotatably connected to said muzzle, and a gear rack that is co-movably connected to said piston and that detachably meshes with said lifting gear so as to be driven by said lifting gear to move said piston from the striking position to the stand-by position.

* * * * *